US009743168B2

(12) United States Patent
Kurtz et al.

(10) Patent No.: US 9,743,168 B2
(45) **Date of Patent: *Aug. 22, 2017**

(54) FLEXIBLE EARPHONE COVER

(71) Applicant: EarSkinz, LLC, Atlanta, GA (US)

(72) Inventors: Jon Robert Kurtz, Loudon, TN (US); Bruce C. Nemec, Madison, WI (US); Jason R. Rohr, Palmyra, WI (US)

(73) Assignee: Jon Robert Kurtz, W. Hollywood, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/063,327

(22) Filed: Mar. 7, 2016

(65) Prior Publication Data

US 2016/0261945 A1 Sep. 8, 2016

Related U.S. Application Data

(63) Continuation of application No. 14/261,294, filed on Apr. 24, 2014, now Pat. No. 9,307,313.

(51) Int. Cl.

| | |
|---|---|
| ***H04R 1/10*** | (2006.01) |
| ***H04R 1/12*** | (2006.01) |
| ***H04R 25/00*** | (2006.01) |

(52) U.S. Cl.

CPC ..... *H04R 1/1016* (2013.01); *H04R 1/105* (2013.01); *H04R 1/1058* (2013.01); *H04R 1/1091* (2013.01); *H04R 1/12* (2013.01); *H04R 25/652* (2013.01); *H04R 1/1033* (2013.01); *H04R 2420/07* (2013.01)

(58) Field of Classification Search

CPC .... H04R 1/105; H04R 1/1016; H04R 1/1066; H04R 25/652; H04R 25/656

See application file for complete search history.

(56) References Cited

U.S. PATENT DOCUMENTS

| | | | |
|---|---|---|---|
| 2,487,038 | A | 11/1949 | Baum |
| 2,508,918 | A | 5/1950 | Hines, Jr. |
| 4,349,083 | A | 9/1982 | Bennett |
| 5,319,163 | A | 6/1994 | Scott |
| 6,411,722 | B1 | 6/2002 | Wolf |
| D686,197 | S | 7/2013 | Kurtz et al. |
| D691,594 | S | 10/2013 | Akana et al. |
| 8,638,970 | B2 | 1/2014 | Burton |
| 2005/0141743 | A1 | 6/2005 | Seto |
| 2005/0147269 | A1 | 7/2005 | Oliveira et al. |

(Continued)

*Primary Examiner* — Matthew Eason

(74) *Attorney, Agent, or Firm* — Morgan, Lewis & Bockius LLP

(57) ABSTRACT

The flexible earphone cover has a flexible main body and a flexible ear cone that extends from the main body. The flexible main body is configured to substantially encase a portion of an earphone. The flexible main body defines an internal cavity for receiving the earphone. It also defines a first opening at a side of the cavity for receiving the earphone there-through. The flexible main body defines a second opening at a side of the cavity. The second opening is smaller than the first opening. Finally, the flexible main body defines a third opening at a side of the cavity. The third opening is smaller than the first opening and the second opening. The flexible ear cone defines a converging passageway from the second opening to an exit configured to direct sound into an ear canal of an ear of a user.

19 Claims, 6 Drawing Sheets

(56) References Cited

U.S. PATENT DOCUMENTS

| | | | | |
|---|---|---|---|---|
| 2012/0237074 | A1 | 9/2012 | Aase | |
| 2013/0343594 | A1 | 12/2013 | Howes et al. | |
| 2013/0343595 | A1 | 12/2013 | Zorkendorfer et al. | |
| 2014/0068944 | A1* | 3/2014 | Aase | H04R 31/006<br>29/896.2 |
| 2014/0138179 | A1* | 5/2014 | Burton | H04R 1/1016<br>181/135 |

* cited by examiner

FLEXIBLE EARPHONE COVER

CROSS-REFERENCE TO RELATED APPLICATION

This application is a continuation of U.S. patent application Ser. No. 14/261,294, filed Apr. 24, 2014 which claims priority and is incorporated herein by reference it its entirety.

The disclosed embodiments relate generally to audio devices, and in particular to covers for in-ear earphones.

BACKGROUND

Ever since the advent of portable media players, such as the SONY WALKMAN and later the APPLE IPOD, people have been listening to music on the go. Nowadays, most, if not all, smart phones include built-in media players. As such, a large percentage of the developed world's population listens to music on portable devices. Often, users wear headphones or earphones to keep private what they are listening to or to not disturb others around them. Many users prefer using earphones over headphones due to their compact size, lightweight, and ease of portability. Headphones are typically placed on or over a user's ear, whereas earphones are smaller than headphones and include small speakers that fit into the outer ear of the wearer, making earphones easier to carry and use on-the-go. Some earphones also direct sound down the user's external auditory meatus or ear canal to the user's tympanic membrane or eardrum where the sound is converted into vibrations that are perceived by the brain as sound.

These days, most portable media players and smart phones are sold with the media player manufacture's standard earphones, such as APPLE'S EARBUDS or EARPODS. These standard earphones are typically made from a rigid material having a smooth outer surface, and are sized for the average person's ear. As such, these standard earphones suffer from a number of drawbacks, such as: (i) not fitting snuggly within all wearer's ears, (ii) made of a hard plastic resulting in the earphones slipping-out of the wearer's ears when the wearer is moving or exercising and/or when the earphone's outer surface is moist from, for example, perspiration, (iii) being uncomfortable when worn for a long period of time, (iv) not adequately directing sound into a user's ear canal, and (v) not adequately blocking ambient noise.

Moreover, earphones, like APPLE's EARPODS, are designed so that the main speaker is covered by a grill that is recessed, i.e., the housing of the earphone extends further than the speaker grill. This design allows unwanted material, such as pocket lint or earwax, to get caught in the recess. Over time the recess collects this unwanted material, which is not easily visible to the user. This unwanted material may degrade the sound quality. Moreover this recess is difficult to clean and could lead to infection or in-ear irritation.

While some covers exist for earphones, these covers are not designed to fit the current style of many earphones; are not removable; are overly complex; or fail to address the above drawbacks. Accordingly, it would be desirable to provide a cover for an earphone that allows users to use their existing earphones, while still addressing the above mentioned drawbacks.

BRIEF DESCRIPTION OF THE DRAWINGS

So that the present disclosure can be understood in greater detail, a more particular description may be had by reference to the features of various embodiments, some of which are illustrated in the appended drawings. The appended drawings, however, merely illustrate the more pertinent features of the present disclosure and are therefore not to be considered limiting, for the description may admit to other effective features.

Figure 1A:
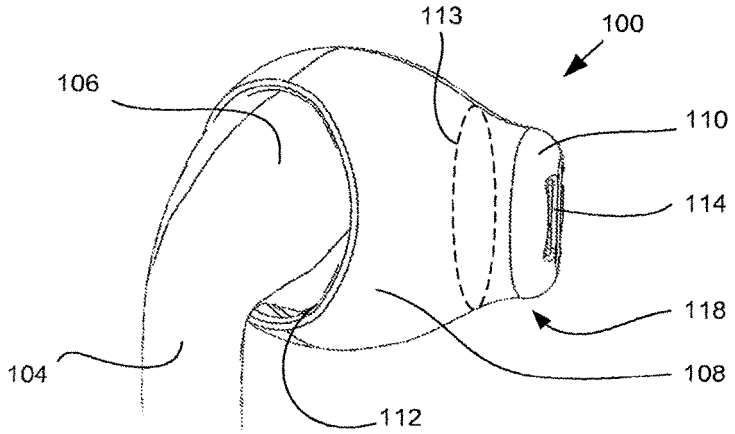
FIG. 1A is a rear oblique view of a cover on an earphone according to one embodiment of the invention.

In accordance with common practice the various features illustrated in the drawings may not be drawn to scale. Accordingly, the dimensions of the various features may be arbitrarily expanded or reduced for clarity. In addition, some of the drawings may not depict all of the components of a given system, method or device. Finally, like reference numerals may be used to denote like features throughout the specification and figures.

DETAILED DESCRIPTION

According to some embodiments there is provided a flexible earphone cover that has a flexible main body and a flexible nose cone or ear cone (referred to herein as "ear cone") that extends from the main body. Earphones, as used herein, refers to any in-ear audio devices. The flexible main body is configured to substantially encase a portion of an earphone. The flexible main body defines an internal cavity for receiving the earphone. It also defines a first opening at a side of the cavity for receiving the earphone there-through. The flexible main body defines a second opening at a side of the cavity. The second opening is smaller than the first opening. Finally, the flexible main body defines a third opening at a side of the cavity. The third opening is smaller than the first opening and the second opening. The flexible ear cone defines a converging passageway from the second opening to an exit configured to direct sound into an ear canal of a user.

Some embodiments also provide a method for making a flexible earphone cover. Initially, an elastomer or other suitable material is injection molded into a mold to integrally form the flexible main body and ear cone described herein. In some embodiments, the earphone cover is made from an elastomer that is injection molded into an injection port or gate disposed within the internal cavity. In some embodiments, the material has a color, is translucent, includes reflective particles, is semi-transparent, is completely transparent, and/or glows in the dark. Where the material is a glow in the dark material, the material may include about 25 percent of a phosphorescent based material.

The main body material (e.g., an elastomer) and the thickness of the main body are selected so that the main body is compliant and elastic. This together with the shape of the main body and ear cone allows the cover to snuggly fit within most, if not all, adult wearer's ears. This also allows the cover (and earphone) to be comfortably worn for long periods of time. This design also results in a cover (and earphone) that does not slip-out of the wearer's ears when the wearer is moving, such as during exercise. This snug fit also prevents some ambient noise from entering the user's ear canal, thereby improving the listening experience, and allowing the user to play the audio at a lower volume.

Other embodiments provide a method for coupling the earphone cover to an earphone. Initially, a cover, as described herein, is provided. The first opening of the flexible main body is then stretched over the appropriate left or right head of the earphone (or the appropriate earphone is inserted into the first opening). In some embodiments, the cover is then manipulated so that the third opening of flexible main body is aligned with a treble hole in the earphone. In other embodiments, the cover is manipulated so that the third opening of flexible main body is aligned with another hole in the earphone, should one exist. In some embodiments, the flexible main body is pulled behind the earphone head to remove any wrinkles or blisters on the surface of the cover. Also in some embodiments, the ear cone is aligned with the main speaker outlet on the earphone head. The earphone and cover can then be inserted into the appropriate left or right outer ear canal of the user with the ear cone directed down the user's ear canal. Audio can then be played through the earphones to be heard by the user.

Figure 1B:
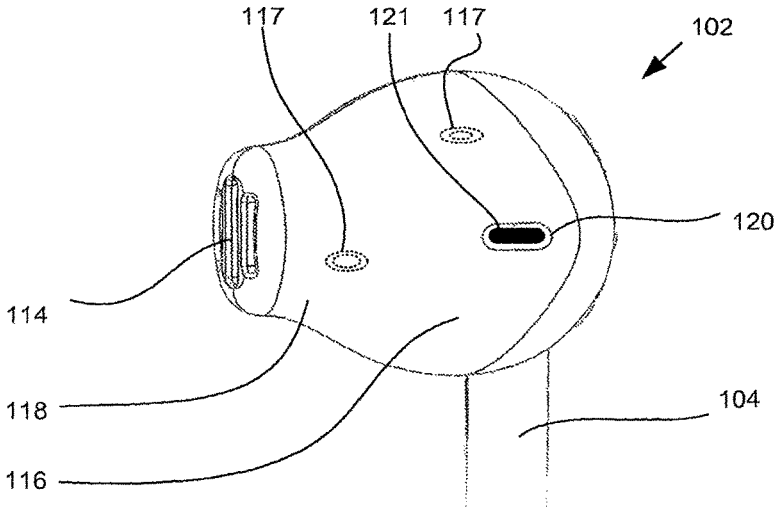
FIG. 1B is a front oblique view of the cover shown in FIG. 1A.
Figure 2:
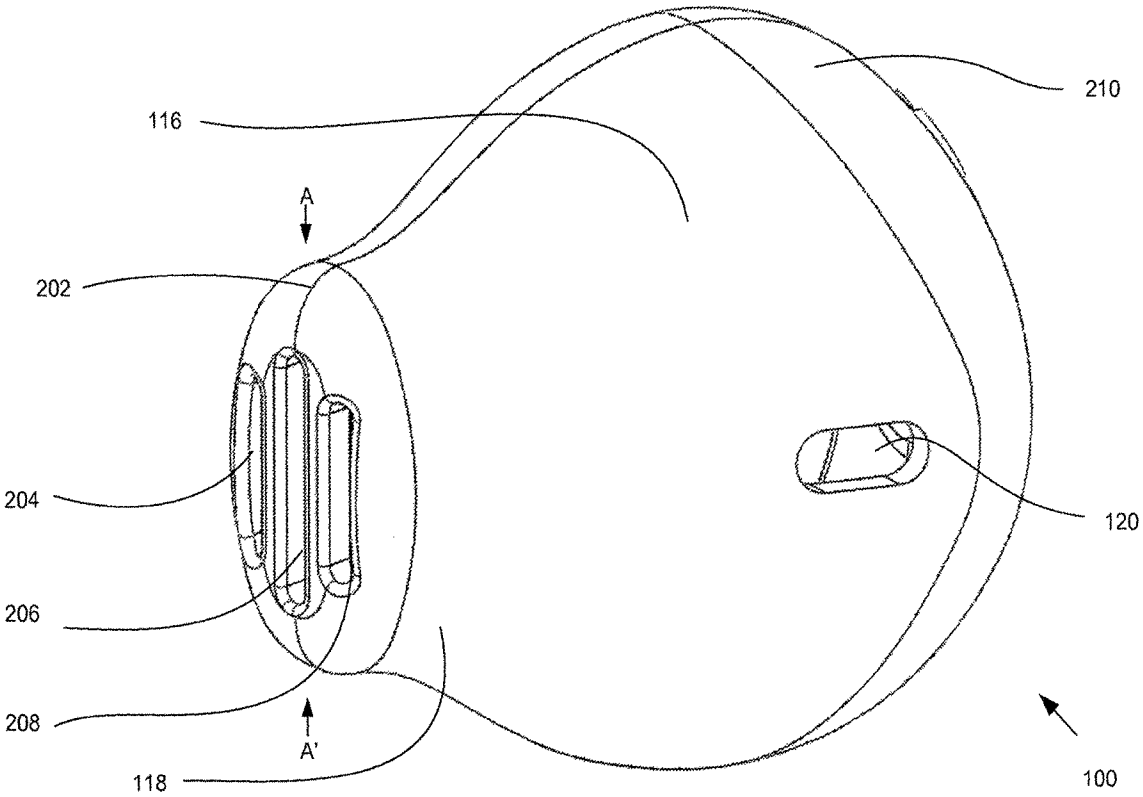
FIG. 2 is a front oblique view of the cover shown in FIGS. 1A and 1B, but here the cover is shown not coupled to an earphone.

FIG. 1A is a rear oblique view of a cover 100 shown coupled to an earphone according to one embodiment of the invention. FIG. 1B is a front oblique view of the cover and earphone shown in FIG. 1A. The cover 100 is configured to be removably coupled to the earphone. FIG. 2 is a front oblique view of the cover shown in FIGS. 1A and 1B, but here the cover 100 is shown on its own, i.e., not coupled to an earphone.

Figure 3:
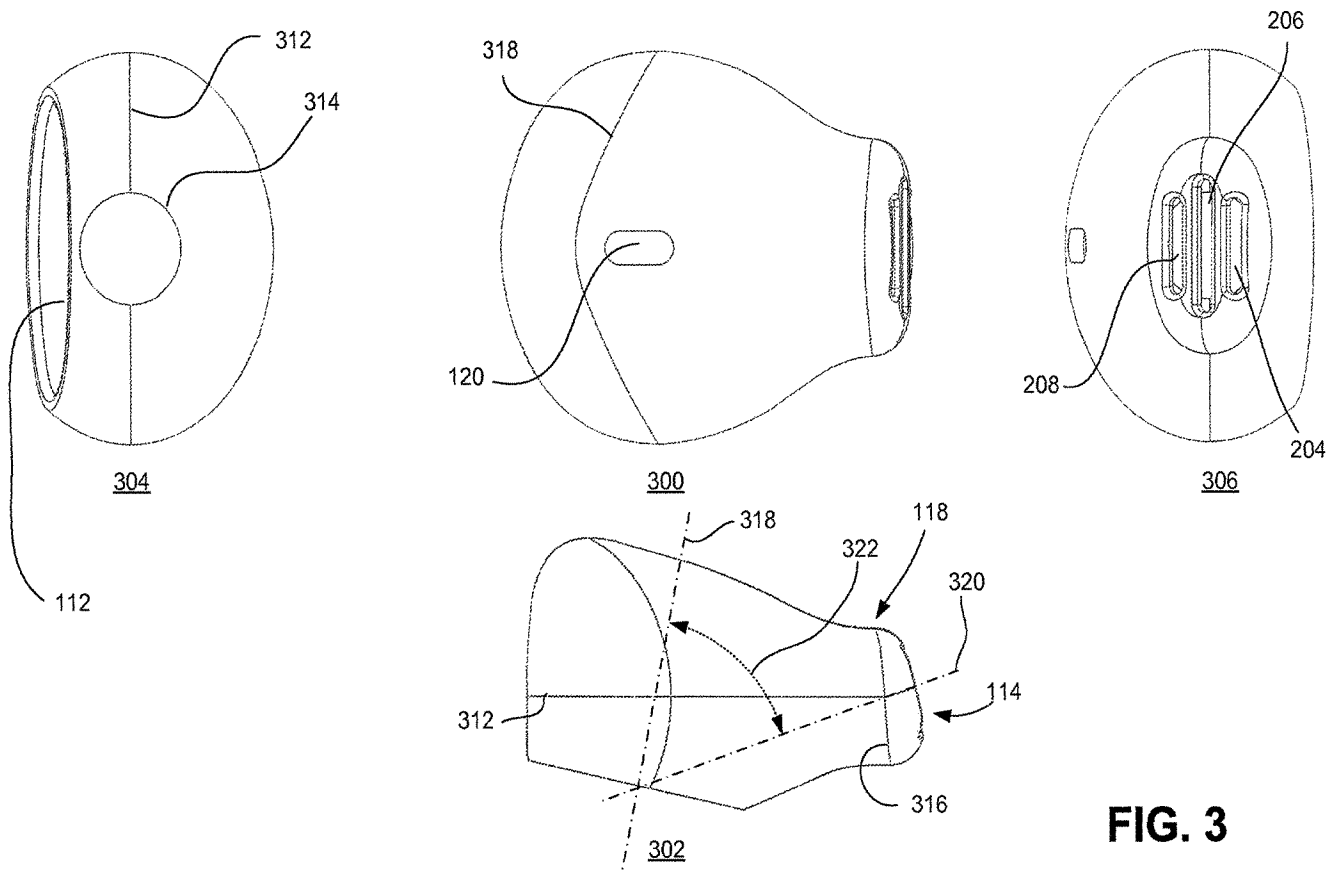
FIG. 3 shows top, side, front, and back views of the cover shown in FIGS. 1A, 1B, and 2.
Figure 4:
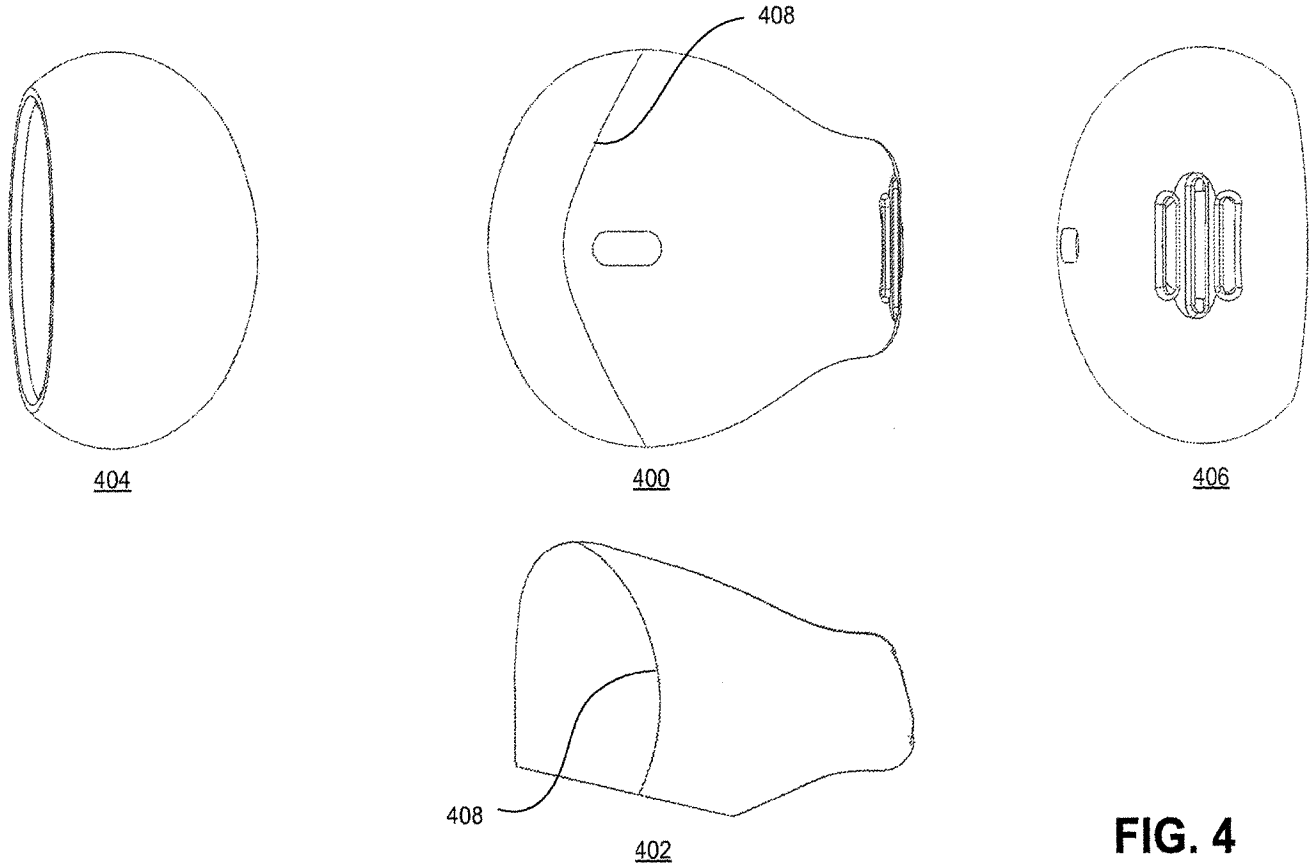
FIG. 4 shows top, side, front, and back views of a cover according to another embodiment of the invention.

In some embodiments, the earphone includes a head 106 connected to a neck or stem 104. A cable (not shown) carrying electrical signals passes through the stem 104 and is connected to one or more speakers (not shown) within the head 106. In some embodiments, the cover 100 is configured to be coupled to APPLE'S EARPOD earphone, such as the earphones shown and described in U.S. Pat. No. USD691594, and U.S. Patent Application Nos. US 20130343595 and US 20120237074. The contents of the aforementioned patent and patent applications are hereby incorporated by reference in their entirety. Other suitable earphones may include different configurations, such as an earphone with no stem, a wireless earphone that include wireless (such as BLUETOOTH) circuitry, or the like. It should also be noted that the separate and distinct covers 100 are provided for a left earphone and a right earphone. FIG. 1A shows a cover and earphone for a right ear, but a cover having a mirrored geometry is configured to fit an earphone for a left ear, as shown in FIGS. 3 and 4.

The cover 100 includes a main body 108 and an ear cone 118 that extends from the main body 108. In some embodiments, both the main body 108 and the ear cone 118 are flexible. In other embodiments, only the main body 108 is flexible. In yet other embodiments, the main body 108 is more flexible than the ear cone 118. In some embodiments, the thickness of the material of the cover is thickest around the first opening. In other embodiments, the thickness of the material of the cover is thickest at the ear cone. In other embodiments, the thickness of the material of the cover is thickest at the first opening and at the ear cone. In yet other embodiments, the thickness of the material of the cover is uniform throughout.

In some embodiments, the earphone cover 100 is made from an injection molded flexible elastomer. In other embodiments, the earphone cover is made from an elastomer that does not substantially lose its grip when wet. In fact, in some embodiments, an elastomer is used that provides extra grip or friction when wet. A suitable elastomer is one that: is chemically stabile; is able to be wet with water, alcohol or another cleaner without changing the properties of the material; possesses tensile strength suitable to allow the cover to be stretched over an earphone without tearing and while maintaining the cover's original shape; absorbs and holds its color; and is resistant to weathering and wear and tear.

The main body 108 is configured to substantially encase the head of the earphone. The main body 108 defines an internal cavity for receiving and substantially encasing the head of the earphone, as shown. The main body 108 also defines a first opening 112 at one side of the internal cavity for receiving the head of the earphone there-through. In some embodiments, the first opening 112 has a circular shape. In other embodiments, the first opening 112 has an oval or oblong shape when not installed on an earphone.

The shape, size and configuration of the first opening 112 allows for a better and more secure wrapping of the cover around the earphone. In other words, the cover wraps around the earphone to stay in position and not be easily pulled off the earphone. The oval shape allows the cover to wrap around the earphone while leaving a speaker vent (not shown) on the neck or stem 104 (FIG. 1) of the earphone exposed to ambient air. To the extent that the earphone includes a speaker vent on the stem, covering the vent produces an unwanted tinny sound, as the base frequencies of the audio are not heard. For the APPLE EARPOD, the cover 100 does not cover any vents or openings in the earphone. To the extent that the earphone includes one or more other holes, such as holes for one or more microphones (e.g., for noise cancelation) or sensors, covering these hole (s) may hinder the microphone's or sensor's ability to operate.

The main body 108 defines a second opening at a side of the internal cavity. As the second opening in the main body cannot be seen in these figures, as it is internal to the cover, the location of the second opening is shown by the phantom line 113. In some embodiments, the second opening 113 is smaller than the first opening 112. In some embodiments, the second opening 113 is not positioned opposite the first opening 112, but, instead, is positioned to one side of the main body 108, as shown.

In some embodiments, the main body 108 defines a third opening 120 (best seen in FIG. 1B) at a different side of the internal cavity. In some embodiments, the first opening has a stadium or generally oval geometric shape when viewed from above. The third opening 120 is smaller than the first opening 112 and the second opening 113. In some embodiments, the third opening 120 is disposed roughly opposite to the first opening 112. In some embodiments, the third opening 120 is offset from a longitudinal axis (shown in FIG. 3 as reference numeral 318) formed through the center of the first opening 112. In other words, in some embodiments, the third opening 120 is not directly opposite the center of the first opening 112.

In some embodiments, the third opening 120 is configured to pass sound from the earphone into the ear of the user. In some embodiments, the third opening 120 is configured to pass sound in the treble range of frequencies from a treble hole 121 in the earphone into the ear of the user. The treble hole 121 of the speaker is also known as the front leak, which provides proper venting for a speaker driver to tune to a particular frequency range, e.g., the higher frequency portion of the frequency response. See, e.g., published U.S. patent application No. 20130343595.

In some embodiments, the flexible ear cone 118 defines a substantially converging passageway from the second opening to an exit 114. Here, the cover is configured to direct sound from the speaker in the earphone toward the exit 114, so as to direct sound into an ear canal of an ear of a user.

In some embodiments, the earphone includes one or more additional holes or vents, such as for microphones or other sensors used for noise-cancellation. In these embodiments, either the third hole 120 or other holes 117 may be formed in the cover to align with the corresponding holes in the earphone. In some embodiments, these additional holes are formed in the main body 116, while in other embodiments, they are formed in the cone 118.

In some embodiments, the exit 114 includes a grill with multiple substantially parallel slots or slits. In some embodiments, there are three of these slits 204, 206, 208 (best seen in FIG. 2) that are substantially parallel to one another. These slits are relatively large so as to funnel more sound through the ear canal and allow the user to play audio at a lower volume, thereby using less power and preventing damage to the ear drum. In some embodiments, the middle slit 206 is substantially longer than the other two slits 204, 208 on either side of the middle slit. One of skill in the art should appreciate that other exit 114 configurations are possible.

Moreover, in some embodiments, the end of the ear cone 118 is angled to allow for a slightly larger exit surface area. This larger surface area allows for larger slits 204, 206, and/or 208, which, in turn, facilitates more sound passing through the slits to the user's ear canal(s) while maintaining stability. This angle is shown by reference numeral 323, and is measured between a substantially flat end portion at the end of the ear cone 118 and a line substantially parallel with a plane formed by the second hole 113 (see FIG. 1A).

The slits 204, 206, 208 on the cover 100 block unwanted material (e.g., pocket lint or earwax) from entering a recess in the earphone, thereby ensuring better sound quality. In use, the cover can be cleaned or swabbed with alcohol or water. This cleaning also prevents unwanted material caught in the earphone from transferring back into the ear of the use, thereby reducing the chance for spreading infection. The user can also squeeze the sides of the ear cone 118, as shown by arrows A, A', to enlarge or change the shape of the slits 204, 206, 208 so as to aid in removing the unwanted material from the ear cone and the slits 204, 206, 208.

Alternatively, the user can easily remove the cover 100 to clean the exit 114 and slits 204, 206, 208 from any unwanted material that has accumulated at or near the exit 114.

In some embodiments, other than the first 112, second 113, and third 120 openings, the main body 108 has no other holes formed therein. In some embodiments, the entire outer surface of the earphone cover 100 is substantially smooth with no substantial ridges or sharp edges. Also in some embodiments, the main body 108 is configured not to cover any vent holes in the earphone.

FIG. 3 shows top 300, side 302, front 306, and back 304 views of the cover 100 shown in FIGS. 1A, 1B, and 2. As is evident from these figures, the ear cone does not extend along the longitudinal axis 320. Instead, as best seen in the side view, 302, in some embodiments, the angle 322 between a longitudinal axis 318 that extends through a center of the ear cone 118 and a longitudinal axis 320 that extends through a center of the first opening 112 is between about 45 degrees and about 85 degrees. In a more preferable embodiment, this angle 322 is between about 55 degrees and about 80 degrees. In yet another preferred embodiment, this angle 322 is about 60 degrees to about 75 degrees. When inserted in the ear, the angle of the ear cone points down the ear canal and provides better stability and sound. A cone that does not have the abovementioned angles may rest against the bone, muffle the sound, and compromise the grip and/or stability. In other words, the shape and angle of the ear cone efficiently direct sound into a user's ear canal so that the user can listen to audio at a lower volume. In addition, the angle or the ear cone enables the cover to be relatively short while maintaining stability.

Also shown in FIG. 3 are a number of mold parting lines 312, 314, 316, 318. These lines are formed where different sections of the mold used to form the cover join together. Different embodiments include more or less of these lines 312, 314, 316. In the case of line 318, the mold sections are specifically designed to provide an aesthetically pleasing curve that skirts the third opening 120, as shown.

FIG. 4 shows top 400, side 402, front 406, and back 404 views of a cover according to another embodiment of the invention. Here there is only a single mold parting line 408 (similar to line 318 in FIG. 3) and the cover is formed from only two mold sections that join together at line 408.

Figure 5:
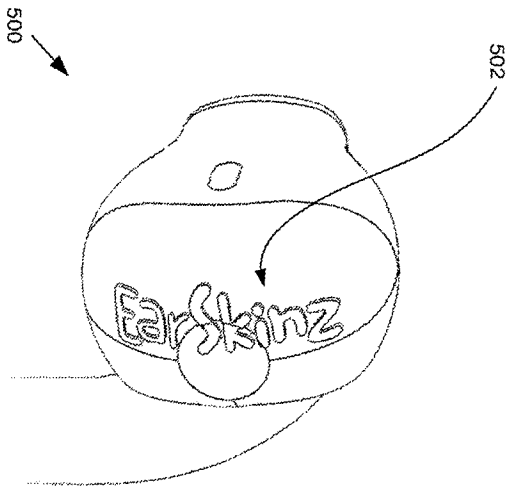
FIG. 5 shows a rear oblique view of a cover on an earphone according to yet another embodiment of the invention.

FIG. 5 shows a rear oblique view or a cover 500 on an earphone according to yet another embodiment of the invention. Here, a logo 502 is integrally formed into the cover at the time of injection molding. In some embodiments, this logo is formed at the rear or back of the cover, as shown.

In some embodiments, the mold used to make the cover includes one or more vents (e.g., at or around the ear or nose cone) to facilitate flow of material into the entire mold, i.e., to completely fill the mold.

Figure 6:
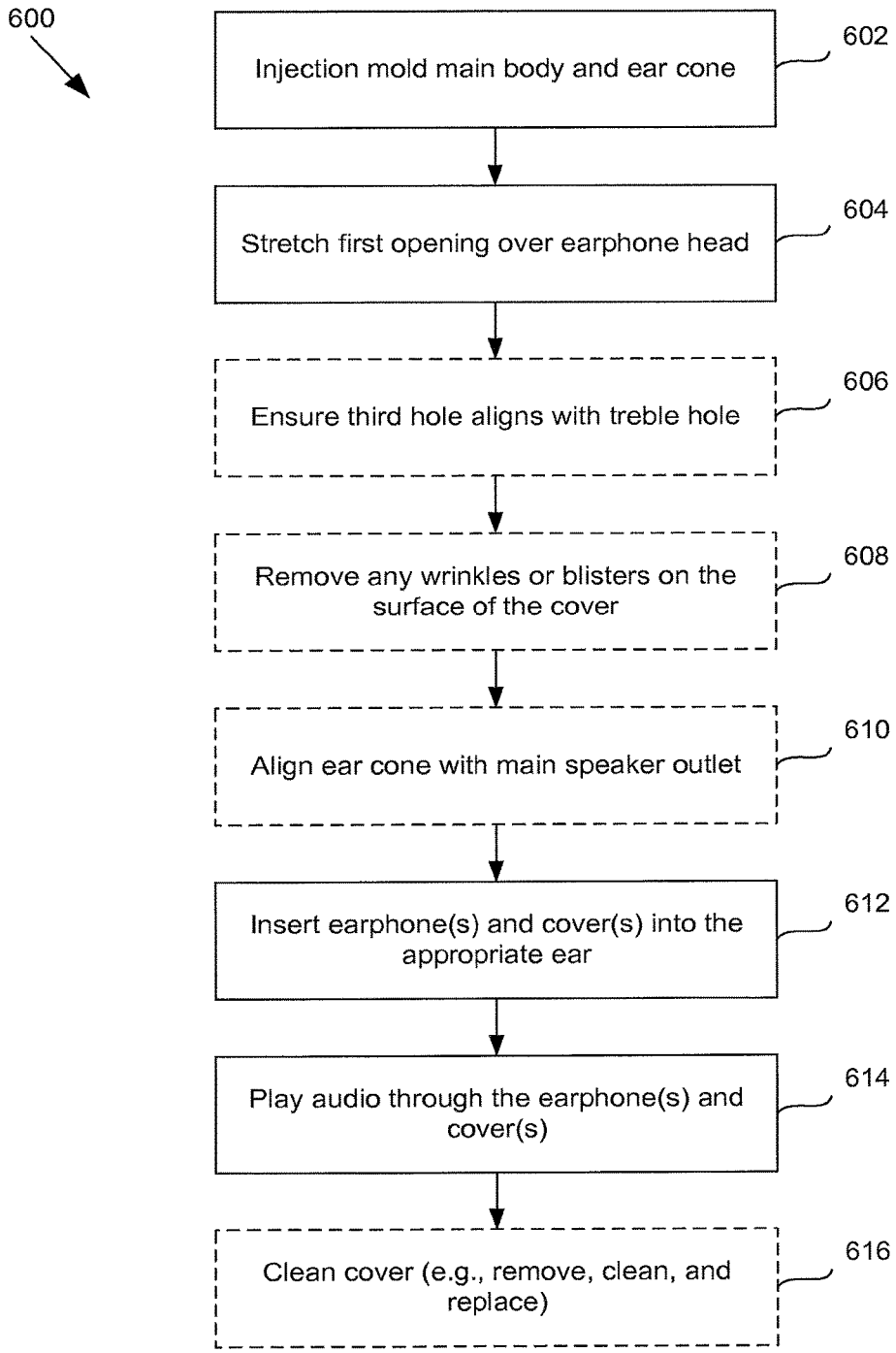
FIG. 6 is a flow chart of a method for making a cover, installing the cover on an earphone, and using the cover.

FIG. 6 is a flow chart 600 of a method for making a cover, installing the cover on an earphone, and using the cover. Initially, an elastomer or other suitable material is injection molded (602) into a mold to integrally form the flexible main body and ear cone described above. In some embodiments, the main body and car cone are integrally formed out of a material having a uniform thickness. In some embodiments, the main body and ear cone are integrally formed out of a material having a thickness that is thicker near the first opening than the remainder of the main body and ear cone. In other embodiments, the main body and ear cone are integrally formed out of a material having a thickness that is thinner near the first opening than the remainder of the main body and ear cone. In some embodiments, the earphone cover is made from an elastomer that is injection molded into an injection gate within the internal cavity so as to avoid blush on the exterior surface of the cover.

Once the user is provided with the cover, they are able to couple the cover to the earphone. To do this, the first opening of the flexible main body is stretched (604) over the appropriate left or right head of the earphone (or the appropriate earphone is inserted into the first opening). The cover is then manipulated (606) so that the third opening of flexible main body is aligned with a treble hole (or any other hole(s)) in the earphone, should any exist. In some embodiments, the flexible main body is pulled behind the earphone head to remove (608) any wrinkles or blisters on the surface of the cover. Also in some embodiments, the ear cone is aligned (610) with the main speaker outlet on the earphone head, and any other holes that may exist on the earphone.

The earphone and cover can then be inserted (612) into an appropriate left or right outer ear canal of the user, with the ear cone directed down the user's ear canal. Audio can then be played (614) through the earphones to be heard by the user. At any time, the cover can be cleaned (616) by cleaning the exit (or slits of the exit) to remove any foreign material. Alternatively, the cover can be removed, cleaned, and replaced onto the earphone.

A person skilled in the art will recognize that the invention or inventions described and claimed herein are not limited to the specific earphones described here, and instead cover all suitable earphones to which a cover may be coupled as would be understood by one skilled in the art.

It will be understood that, although the terms "first," "second," etc. may be used herein to describe various elements, these elements should not be limited by these terms. These terms are only used to distinguish one element from another. For example, a first contact could be termed a second contact, and, similarly, a second contact could be termed a first contact, without changing the meaning of the description, so long as all occurrences of the "first contact" are renamed consistently and all occurrences of the second contact are renamed consistently. The first contact and the second contact are both contacts, but they are not the same contact.

The terminology used herein is for the purpose of describing particular embodiments only and is not intended to be limiting of the claims. As used in the description of the embodiments and the appended claims, the singular forms "a", "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The foregoing description, for purpose of explanation, has been described with reference to specific embodiments. However, the illustrative discussions above are not intended to be exhaustive or to limit the claims to the precise forms disclosed. Many modifications and variations are possible in view of the above teachings. The embodiments were chosen and described in order to best explain principles of operation and practical applications, to thereby enable others skilled in the art.

What we claim is:

1. A flexible earphone cover, comprising:

a flexible main body configured to substantially encase a portion of an earphone, wherein the flexible main body defines:

an internal cavity for receiving the earphone;

a first opening at a side of the cavity for receiving the earphone there-through;

a second opening at a side of the cavity, the second opening being smaller than the first opening; and a third opening at a side of the cavity, the third opening being smaller than the first opening and the second opening, wherein the third opening is configured to pass sound from a hole in the earphone into the ear of the user, and wherein the main body defines no other holes therein;

a flexible ear cone extending from the main body, the flexible ear cone defining a converging passageway from the second opening to an exit configured to direct sound into an ear canal of a user.

2. The flexible earphone cover of claim 1, wherein an angle between a longitudinal axis that extends through a center of the ear cone and a longitudinal axis that extends through a center of the first opening is between about 55 degrees and about 80 degrees.

3. The flexible earphone cover of claim 1, wherein the third opening is configured to pass sound in a treble range of frequencies into the ear of the user.

4. The flexible earphone cover of claim 1, wherein an entire outer surface of the earphone cover is substantially smooth with no sharp edges.

5. The flexible earphone cover of claim 1, wherein the main body is configured not to cover any holes formed in the earphone.

6. The flexible earphone cover of claim 1, wherein the third opening is formed at an opposite side of the main body to the first opening.

7. The flexible earphone cover of claim 6, wherein the third opening offset from a longitudinal axis formed through the first opening.

8. The flexible earphone cover of claim 7, wherein the third opening has a stadium shape.

9. The flexible earphone cover of claim 7, wherein the third opening has a shape that matches the shape of a corresponding hole formed in the earphone.

10. The flexible earphone cover of claim 1, wherein the main body and ear cone are integrally formed out of a material having a uniform thickness.

11. The flexible earphone cover of claim 1, wherein the main body and ear cone are integrally formed out of a material having a thickness that is thicker near the first opening than the remainder of the main body and ear cone.

12. The flexible earphone cover of claim 1, wherein the main body and ear cone are integrally formed out of a material having a thickness that is thinner near the first opening than the remainder of the main body and ear cone.

13. The flexible earphone cover of claim 1, wherein the earphone cover is made from an injection molded flexible elastomer.

14. The flexible earphone cover of claim 1, wherein the earphone cover is made from an elastomer that does not substantially lose its grip when wet.

15. The flexible earphone cover of claim 1, wherein the earphone cover is made from an elastomer that is injection molded into an injection gate within the internal cavity.

16. The flexible earphone cover of claim 1, wherein the first opening is an oval or oblong.

17. The flexible earphone cover of claim 1, wherein the main body has a logo integrally formed therein.

18. A method of producing a flexible earphone cover comprising:

integrally forming a flexible main body and a flexible ear cone by injection molding a flexible elastomer to form:

(i) the main body defining:

an internal cavity for receiving an earphone;

a first opening at a side of the cavity for receiving the earphone there-through;

a second opening at a side of the cavity, the second opening being smaller than the first opening; and a third opening at a side of the cavity, the third opening being smaller than the first opening and the second opening, wherein the third opening is configured to pass sound from a hole in the earphone into the ear of the user, and wherein the main body defines no other holes therein; and (ii) the flexible ear cone that extends from the main body and defines a converging passageway from the second opening to an exit configured to direct sound into an ear canal of a user.

19. The flexible earphone cover of claim 1, wherein the flexible main body is pulled behind a head of the earphone to remove wrinkles or blisters on a surface of the flexible earphone cover.

* * * * *